US009033046B2

(12) United States Patent
Andrew et al.

(10) Patent No.: US 9,033,046 B2
(45) Date of Patent: May 19, 2015

(54) MULTI-ZONE FRACTURING AND SAND CONTROL COMPLETION SYSTEM AND METHOD THEREOF

(71) Applicants: Colin P. Andrew, Houston, TX (US); Bradley G. Baker, Houston, TX (US); Michael H. Johnson, Katy, TX (US)

(72) Inventors: Colin P. Andrew, Houston, TX (US); Bradley G. Baker, Houston, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 13/648,489

(22) Filed: Oct. 10, 2012

(65) Prior Publication Data

US 2014/0096970 A1 Apr. 10, 2014

(51) Int. Cl.
*E21B 43/26* (2006.01)
*E21B 43/112* (2006.01)
*E21B 43/14* (2006.01)

(52) U.S. Cl.
CPC ..... *E21B 43/26* (2013.01); *E21B 43/112* (2013.01); *E21B 43/14* (2013.01)

(58) Field of Classification Search
CPC ..... E21B 43/112; E21B 43/114; E21B 43/26
USPC ..... 166/271, 308.1, 177.5
See application file for complete search history.

(56) References Cited

U.S. PATENT DOCUMENTS 2,708,000 A * 5/1955 Zandmer ..... 166/100
2,855,049 A * 10/1958 Zandmer ..... 166/100
3,120,268 A * 2/1964 Caldwell ..... 166/100
3,245,472 A * 4/1966 Zandmer ..... 166/100
3,322,199 A * 5/1967 Van Note, Jr. ..... 166/205
3,390,724 A * 7/1968 Caldwell ..... 166/100
3,924,677 A * 12/1975 Prenner et al. ..... 166/100
4,285,398 A * 8/1981 Zandmer et al. ..... 166/100
5,224,556 A * 7/1993 Wilson et al. ..... 175/4.53
5,425,424 A * 6/1995 Reinhardt et al. ..... 166/291
5,829,520 A * 11/1998 Johnson ..... 166/250.01
6,095,247 A * 8/2000 Streich et al. ..... 166/299
7,316,274 B2 1/2008 Xu et al.
7,419,003 B2 9/2008 Russell
7,475,729 B2 * 1/2009 Johnson ..... 166/305.1
7,591,312 B2 * 9/2009 Johnson et al. ..... 166/278
7,637,318 B2 * 12/2009 Sierra et al. ..... 166/250.07
7,644,854 B1 1/2010 Holmes et al.
7,748,459 B2 7/2010 Johnson (Continued)

OTHER PUBLICATIONS

Garry Garfield and Paul McElfresh, Baker Oil Tools, "Novel Completion Technology Eliminates Formation Damage and Reduces Rig Time in Sand Control Applications", SPE/IADC 92596, 2005, SPE/IADC Drilling Conference, Amsterdam, The Netherlands, Feb. 23-25, 2005, pp. 1-6.

(Continued)

*Primary Examiner* — Kenneth L Thompson
(74) *Attorney, Agent, or Firm* — Cantor Colburn LLP

(57) ABSTRACT

A multi-zone fracturing and sand control completion system employable in a borehole. The system includes a casing. A fracturing assembly including a fracturing telescoping unit extendable from the casing to the borehole and a frac sleeve movable within the casing to access or block the fracturing telescoping unit; and, an opening in the casing. The opening including a dissolvable plugging material capable of maintaining frac pressure in the casing during a fracturing operation through the telescoping unit. Also included is a method of operating within a borehole.

18 Claims, 10 Drawing Sheets

(56) References Cited

U.S. PATENT DOCUMENTS

| | | | | |
|---|---|---|---|---|
| 7,798,213 | B2 * | 9/2010 | Harvey et al. | 166/242.7 |
| 7,938,188 | B2 * | 5/2011 | Richard et al. | 166/308.1 |
| 8,079,416 | B2 * | 12/2011 | Parker | 166/285 |
| 8,171,994 | B2 * | 5/2012 | Murray et al. | 166/308.1 |
| 8,297,364 | B2 * | 10/2012 | Agrawal et al. | 166/376 |
| 8,365,827 | B2 * | 2/2013 | O'Connell et al. | 166/308.1 |
| 8,443,892 | B2 * | 5/2013 | Richard et al. | 166/308.1 |
| 8,646,523 | B2 * | 2/2014 | Huang et al. | 166/100 |
| 8,776,884 | B2 * | 7/2014 | Xu et al. | 166/308.1 |
| 8,789,600 | B2 * | 7/2014 | O'Connell et al. | 166/308.1 |
| 2010/0263871 | A1 | 10/2010 | Xu et al. | |
| 2011/0114319 | A1 * | 5/2011 | Xu et al. | 166/308.1 |
| 2011/0132143 | A1 | 6/2011 | Xu et al. | |
| 2011/0132612 | A1 | 6/2011 | Agrawal et al. | |
| 2011/0214881 | A1 | 9/2011 | Newton et al. | |
| 2011/0220361 | A1 * | 9/2011 | Huang | 166/308.1 |
| 2011/0220362 | A1 | 9/2011 | Huang et al. | |
| 2011/0315226 | A1 | 12/2011 | Xu et al. | |
| 2012/0073819 | A1 | 3/2012 | Richard et al. | |

OTHER PUBLICATIONS

International Search Report and Written Opiinion, Date of mailing Dec. 9, 2013, International Application No. PCT/US2013/058437, Korean Intellectual Property Office, International Search Report 5 pages, Written Opinion 10 pages.

* cited by examiner

MULTI-ZONE FRACTURING AND SAND CONTROL COMPLETION SYSTEM AND METHOD THEREOF

BACKGROUND

In the drilling and completions industry, the formation of boreholes for the purpose of production or injection of fluid is common. The boreholes are used for exploration or extraction of natural resources such as hydrocarbons, oil, gas, water, and alternatively for CO2 sequestration.

To extract the natural resources, it is common to cement a casing string into the borehole and then perforate the string and cement with a perforating gun. The perforations are isolated by installation and setting of packers or bridge plugs, and then fracturing fluid is delivered from the surface to fracture the formation outside of the isolated perforations. The borehole having the cemented casing string is known as a cased hole. The use of a perforating gun is typically performed in sequence from the bottom of the cased hole to the surface. The use of perforating guns practically eliminates the possibility of incorporating optics or sensor cables into an intelligent well system ("IWS") because of the risk of damage to these sensitive systems. Furthermore, once the casing is perforated, screens must be put into place to prevent sand from being produced with desired extracted fluids. A screen must be run on the production pipe and an additional joint of pipe as a seal with a sliding sleeve for a selector flow screen is also included. The incorporation of the sand control system takes up valuable space within an inner diameter of a casing limiting a diameter of a production pipe passed therein. Screens, while necessary for sand control, also have other issues such as hot spots and susceptibility to damage during run-ins that need to be constantly addressed.

In lieu of cement, another common fracturing procedure involves the placement of external packers that isolate zones of the casing. The zones are created through the use of sliding sleeves. This method of fracturing involves proper packer placement when making up the string and delays to allow the packers to swell to isolate the zones. There are also potential uncertainties as to whether all the packers have attained a seal so that the developed pressure in the string is reliably going to the intended zone with the pressure delivered into the string at the surface. Proper sand control and the incorporation of a sand screen are still necessary for subsequent production.

Either of these operations is typically performed in several steps, requiring multiple trips into and out of the borehole with the work string which adds to expensive rig time. The interior diameter of a production tube affects the quantity of production fluids that are produced therethrough, however the ability to incorporate larger production tubes is prohibited by the current systems required for fracturing a formation wall of the borehole and subsequent sand-free production.

Thus, the art would be receptive to improved systems and methods for limiting the number of trips made into a borehole, increasing the available inner space for production, protecting intelligent systems in the borehole, and ultimately decreasing costs and increasing production.

BRIEF DESCRIPTION

A multi-zone fracturing and sand control completion system employable in a borehole, the system includes a casing; a fracturing assembly including a fracturing telescoping unit extendable from the casing to the borehole and a frac sleeve movable within the casing to access or block the fracturing telescoping unit; and, an opening in the casing, the opening including a dissolvable plugging material capable of maintaining frac pressure in the casing during a fracturing operation through the telescoping unit.

A method of operating within a borehole, the method includes providing a casing within a borehole, the borehole having a diameter between approximately 8.5" and 10.75"; and, running a tubular within the casing, the tubular having an outer diameter greater than 2⅞".

A method of operating within a borehole, the method includes providing a casing within the borehole, the casing having an opening including a dissolvable plugging material; extending a fracturing telescoping unit of a fracturing assembly from the casing to a formation wall of the borehole; fracturing the formation wall through the fracturing telescoping unit; moving a sleeve within the casing to block the fracturing telescoping unit; running a tubular within the casing; and dissolving the plugging material, wherein the plugging material is capable of maintaining frac pressure within the casing during a fracturing operation.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
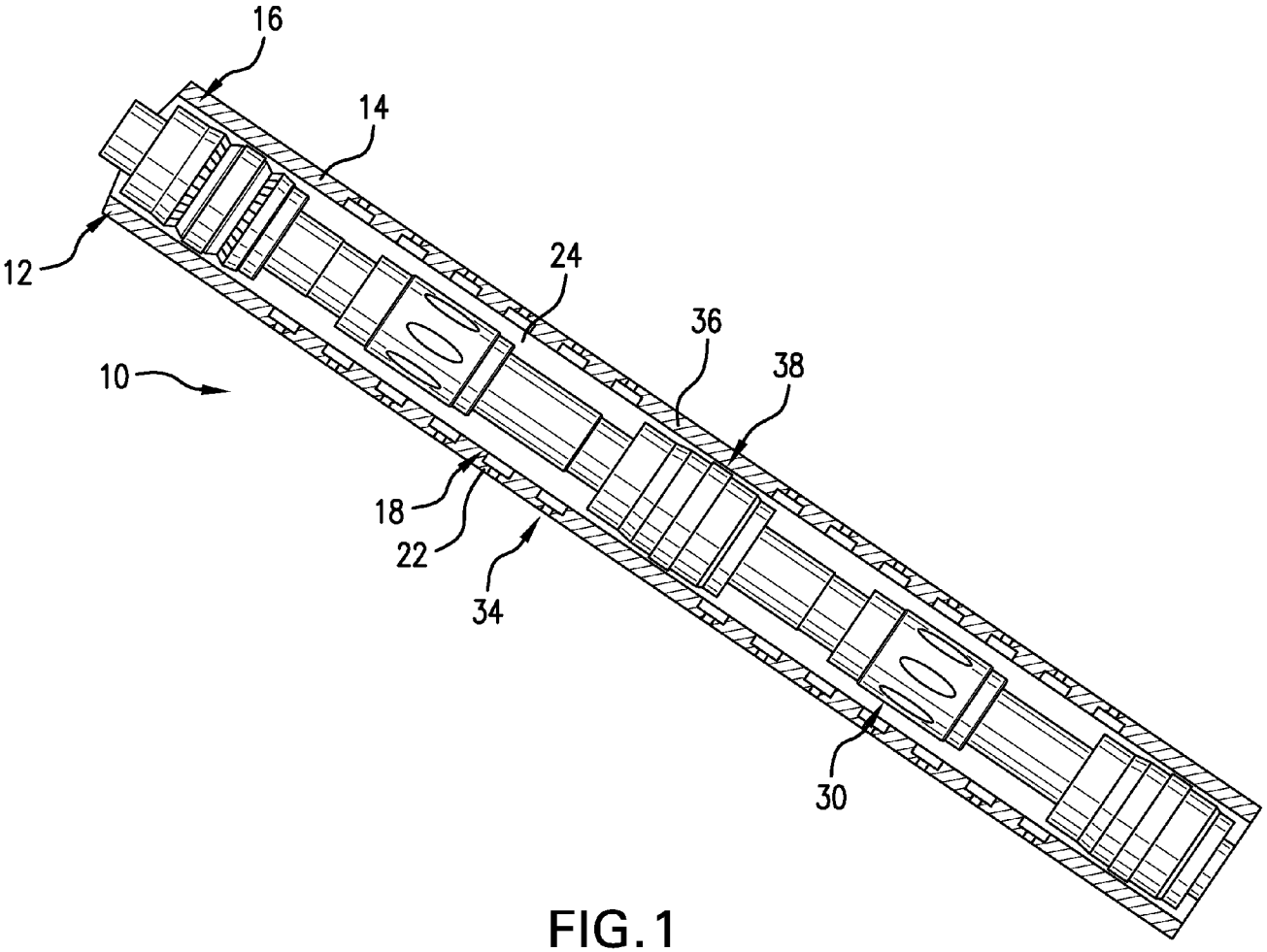
FIG. 1 shows a partial perspective view and partial cross-sectional view of an exemplary embodiment of a one-trip multi-zone fracturing and sand control completion system in a borehole.
Figure 2:
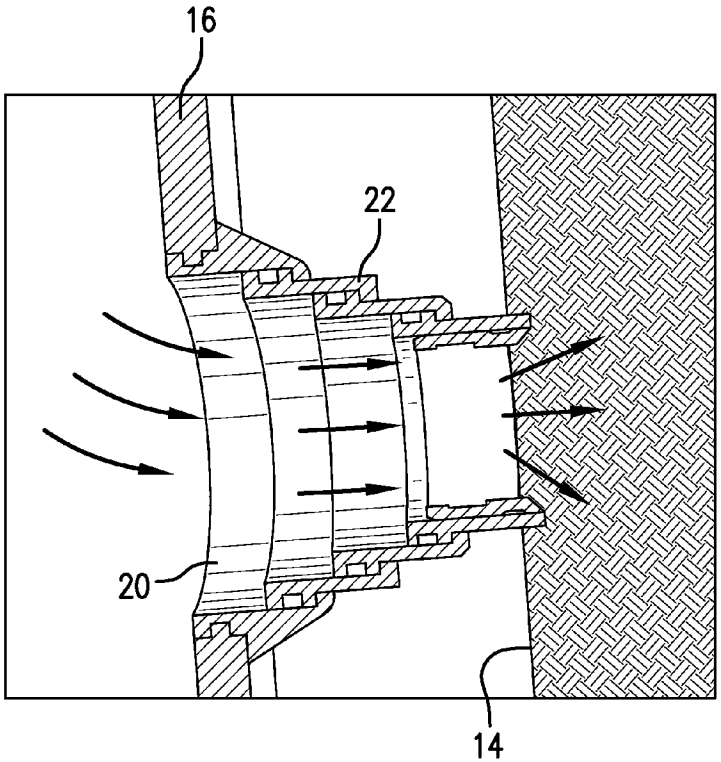
FIG. 2 shows a cross-sectional view of an exemplary embodiment of a fracturing telescoping assembly.

FIG. 1 shows an overview of an exemplary embodiment of a one-trip multi-zone fracturing and sand control completion system 10. The system 10 is usable in a borehole 12 that is formed from a surface through a formation, exposing a formation wall 14 in the borehole 12. In this exemplary embodiment, the borehole 12 is 10¾" diameter in order to accommodate a 9⅞" outer diameter ("OD") production casing 16 having an 8.5" inner diameter ("ID"). In the exemplary system 10 described herein, the casing 16 does not require perforation and therefore optics and sensor cables can be included therein, or even on an exterior of the casing 16, without risk of damage by perforating guns. In order to fracture the surrounding formation, a fracturing assembly 18 includes openings 20 (shown in FIG. 2) in the casing 16 that are provided with fracturing telescoping units 22 and an interior sleeve 24, such as a frac sleeve, that can be arranged to block the openings 20 subsequent a fracturing operation. An exemplary embodiment of the fracturing telescoping units 22 is shown in more detail in FIG. 2. Depending on the formation itself, when the formation is fractured, the fractures may grow up and/or down from the fracturing location. Therefore, production openings 26 (shown in FIG. 3) are provided both uphole and downhole of the fracturing openings 20 to maximize production within each zone. The production openings 26 are not covered by the sleeve 24, and because the production openings 26 must hold pressure in the casing 16 to allow the fracturing operation to be performed effectively, the production openings 26 are filled with a plugging material 28, such as a metallic material, that holds the pressure until at least subsequent the fracturing operations and insertion of a production tubular 30, after which it can be dissolved or corroded out. The production openings 26 further include a porous material 32 that remains intact even after the dissolution of the plugging material 28 therein, particularly for when the system 10 is employed in an open (uncemented) borehole 12. In an exemplary embodiment, the production openings 26 also include production telescoping units 34, as shown in more detail in FIG. 3. Although the system described herein is usable in an open (uncemented) borehole 12, the telescoping units 22, 34 of the fracturing openings 20 and the production openings 26 allow for the casing 16 to be cemented within the borehole 12 using cement 36 without blocking any of the openings 20, 26 since the telescoping units 22, 34 can be extended to the formation wall 14 prior to the cementing operation. While prior fracturing systems require crossover tools that suffer from erosion that limits the number of fractures to two or three before tripping, system 10 contains a large bore area on the order of 2 to 4 times the bore area of current crossover tools which minimizes erosion through the placement tool essentially allowing for 6 to 12 fractures to be placed in a single trip. Utilizing computational flow dynamics and fracture modeling, system 10 could potentially be used for a single trip multizone fracturing system where any number of zones are enabled and any quantity of proppant volumes are allowed to pass therethrough.

As further shown in FIG. 1, the production tubular 30, such as an intelligent well system ("IWS"), is insertable into the casing 16. The production tubular 30 includes isolation devices, hereinafter referred to as packers 38, on an exterior of the production tubular 30, and spanning an annulus between an exterior of the production tubular 30 and an interior of the casing 16, to isolate zones from each other. Each zone preferably includes at least one fracturing telescoping unit 22, at least one production opening 26 between an uphole packer 38 of the zone and the at least one fracturing telescoping unit 22, and at least one production opening 26 between a downhole packer 38 of the zone and the at least one fracturing telescoping unit 22. Placing the fracturing openings 20 between the production openings 26 within each zone maximizes production. Due in part to the fracturing openings 20 which eliminate the need for interior structures within the casing 16 to accommodate a perforating gun, and due in part to the production openings 26 having sand control which eliminates the need for a separate screen pipe, the production tubular 30 inserted within the 8.5" inner diameter of the casing 16 is a 5½" IWS, or approximately 51% of the borehole, which is much greater than a standard 2⅞" production tubular that is normally employed in a 8.5" borehole, or approximately only 34% of the borehole. The bore of the packers 38 likewise are increased to accommodate the larger production tubular 30. The resultant system 10 enabling the use of a larger production tubular 30 is capable of greatly increasing the number of barrels per day that can be produced therethrough as opposed to a system that can only incorporate a smaller production tubular. The system 10 may further include wet connect/inductive coupler(s) to allow for electric coupling and/or hydraulic coupling to occur between different sections of the completion system 10 within the casing 16.

Figure 4:
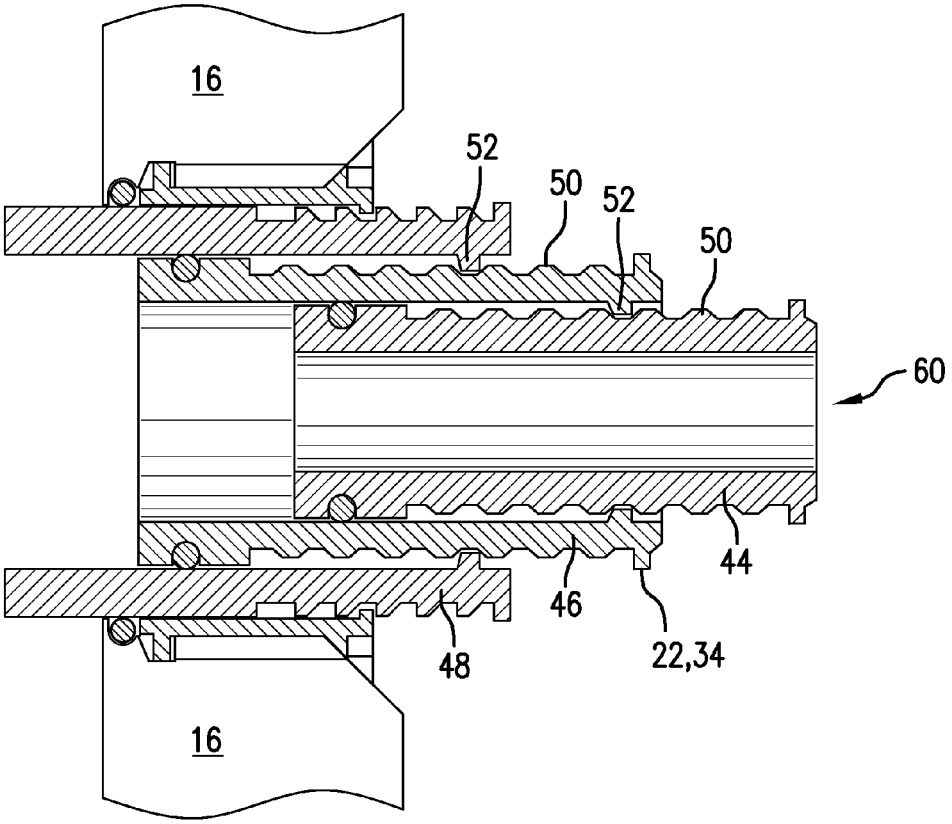
FIG. 4 shows a cross-sectional view of an exemplary embodiment of a telescoping unit for either the fracturing or production telescoping assemblies of FIGS. 2 and 3.

FIG. 4 shows an exemplary telescoping unit 22, 34 for a fracturing assembly 18 and/or production opening 26. The telescoping unit 22, 34 includes any number of nested sections 44, 46, 48. In one exemplary embodiment, the separate sections 44, 46, 48 of the telescoping unit 22, 34 include exterior radial detents 50 that engage with interior detent engaging members 52 on outer sections. Other exemplary embodiments of features of telescoping units 22, 34 for use in the system 10 are described in U.S. Pat. No. 7,798,213 to Harvey et al., which is herein incorporated by reference in its entirety.

As will be described below with respect to FIG. 7, the sliding sleeve 24 for blocking access to the fracturing telescoping unit 22 is movable using a shifting tool 74. Alternatively, the sliding sleeve 24 can be operable with a ball landing on a seat. The telescoping units 22, 34 shown in FIGS. 1-4 are illustrated in an extended position against the formation wall 14, although it should be understood that other telescoping units 22, 34 within the same system 10 may be retracted, such as those within different zones. The fracturing telescoping unit 22 can be initially obstructed with a plug or rupture disc so that internal pressure in the casing 16 will result in telescoping extension between or among sections 44, 46, 48 in each unit 22. The leading ends 60 of the telescoping unit 22 will contact the formation wall 14 such that fracturing fluids will not egress in the surrounding annulus 78 between the casing 16 and formation wall 14 when employed in an open borehole 12 rather than a cemented borehole 12. When cemented, the telescoping units 22, 34 are extended into contact with the formation wall 14 prior to the cementing process to avoid the need for perforation through the cement 36. Once all of the fracturing telescoping units 22 are extended, the plugs/rupture discs in the fracturing telescoping units 22 can be removed. This can be done in many ways but one way is to use plugs that can dissolve such as aluminum alloy plugs that will dissolve in an introduced fluid. The dissolution of the plug or removal of the rupture disc in the fracturing assembly 18 should not affect the plugging material 28 of the production opening 26. Other exemplary embodiments of features of telescoping units 22, 34 for use in the system 10 are described in U.S. Published Application No. 2010/0263871 to Xu et al and U.S. Pat. No. 7,938,188 to Richard et al, both of which are herein incorporated by reference in their entireties.

Figure 3:
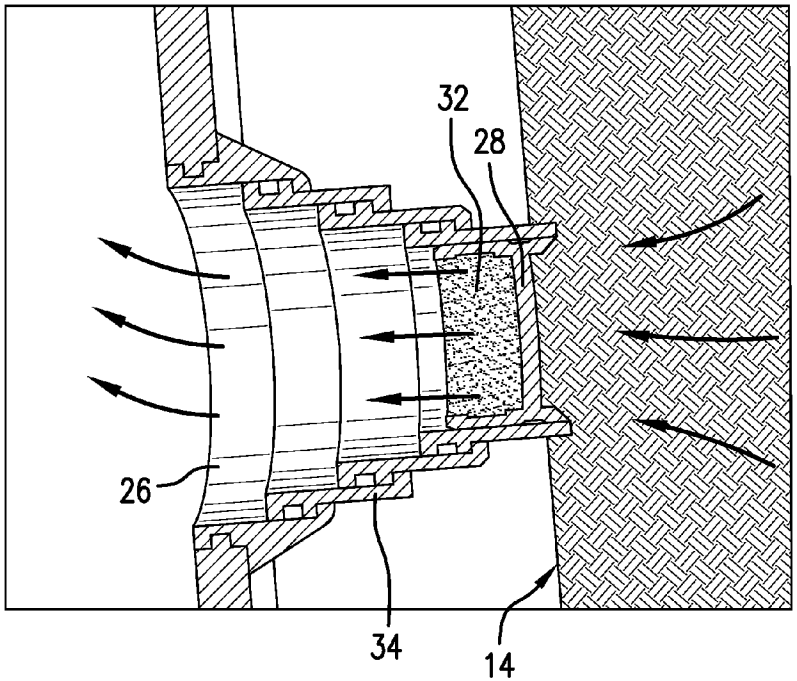
FIG. 3 shows a cross-sectional view of an exemplary embodiment of a production telescoping assembly.
Figure 5:
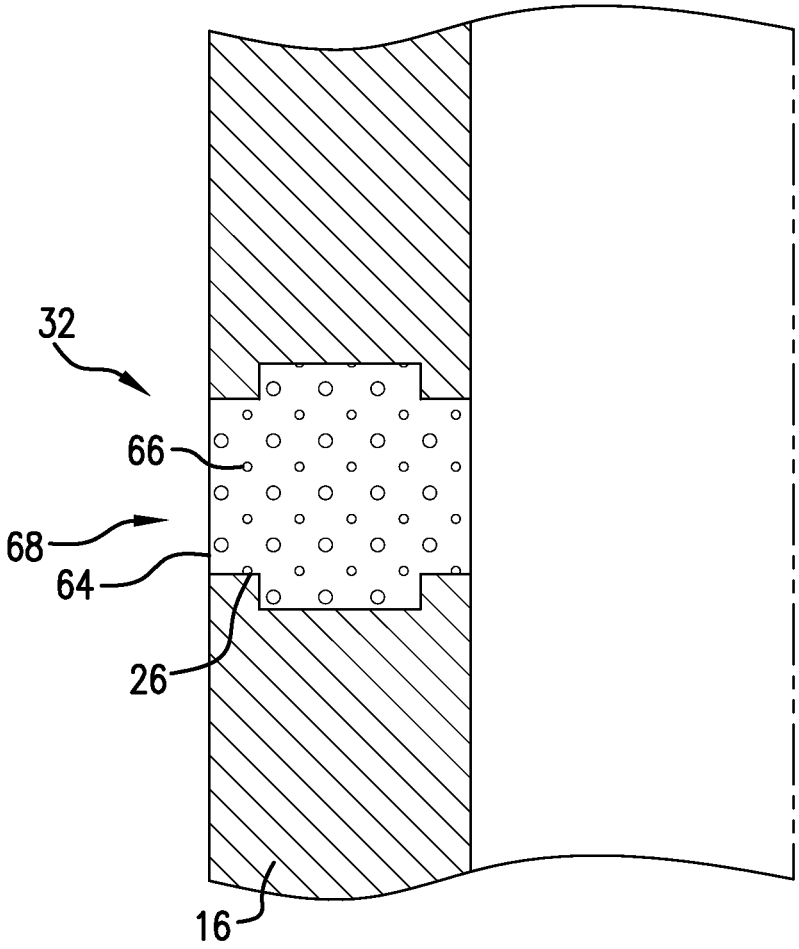
FIG. 5 shows a cross-sectional view of an exemplary embodiment of a porous screen material in a casing.

In at least an open hole application, the production openings 26 include the porous material 32 therein for preventing sand, proppant, or other debris from entering into the casing 14. The porous material 32 should have enough strength to withstand the pressures of fracturing fluids passing through the casing 16. As shown in FIG. 5, solid state reactions between alternating layers of beads of differing materials 64, 66 produces exothermic heat which alone or in conjunction of an applied pressure forms a porous matrix that can be used to fill the production openings 26 of the casing 16. The bi-layer energetic materials are formed from a variety of materials including, but not limited to: Ti & B, Zr & B, Hf & B, Ti & C, Zr & C, Hf & C, Ti & Si, Zr & Si, Nb & Si, Ni & Al, Zr & Al, and Pd & Al. An exemplary method of making the porous material 68 is described in U.S. Pat. No. 7,644,854 to Holmes et al, which is herein incorporated by reference in its entirety. Because the porous material 68 is formed into the opening of the casing 16, or into the telescoping unit 34 as shown in FIG. 3, the inner diameter of the casing 16 is not reduced, and likewise an outer diameter of an inner production tubular 30 can be increased.

Figure 6:
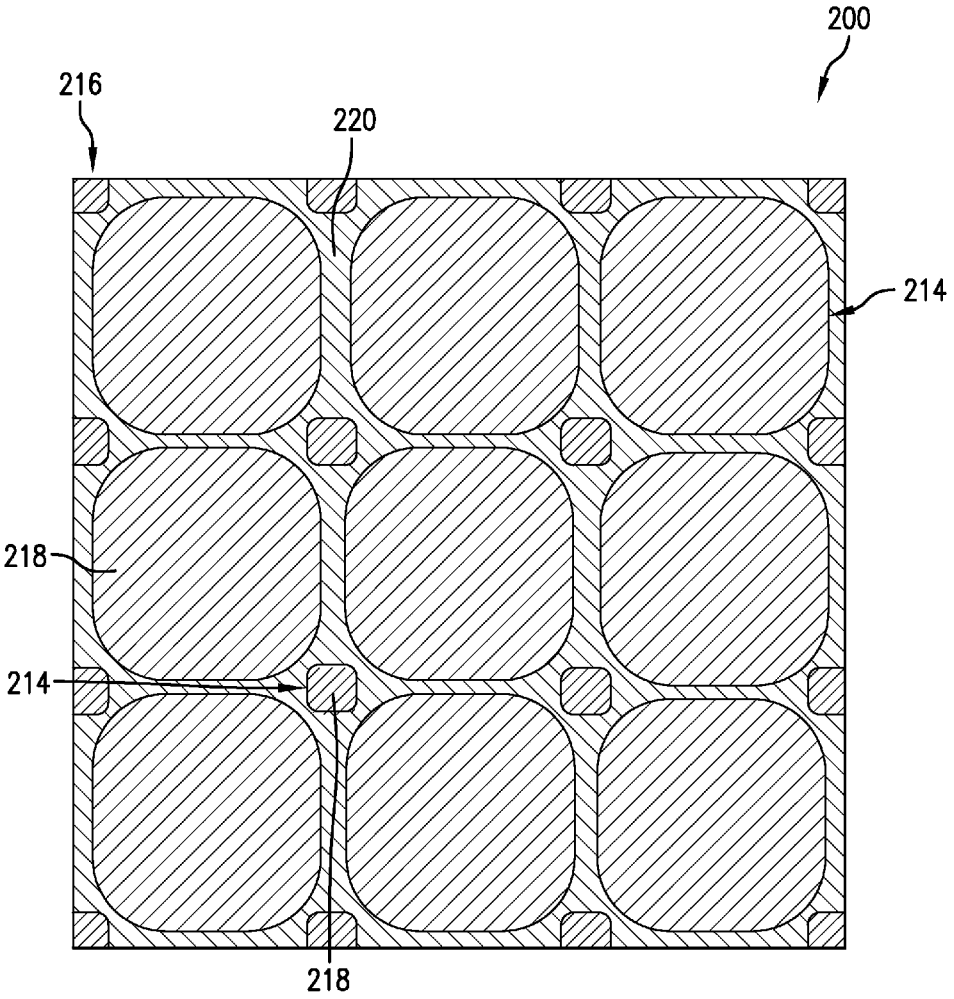
FIG. 6 shows a cross-sectional view of an exemplary embodiment of a dissolvable plugging material.

In either open hole or cased hole application, the casing 16 must be able to perform as a "blank pipe" with at least a pressure rating capable of handling the frac initiation and propagation pressures. If there is any leakage, a separate pipe would be required to seal off the openings 20, 26 which would inevitably take up space within the inner diameter of the casing 16 and reduce an available space for the production tubular 30. Monitoring equipment can be integrated within the casing 16 and exposed to higher than 25 Kpsi screen out pressures. An exemplary embodiment of pressure monitoring equipment is described by U.S. Pat. No. 7,748,459 to Johnson, which is herein incorporated by reference in its entirety. To plug the production openings 26 in a manner able to withstand the frac pressure and to prevent leaks, the plug material 28 includes a nanomatrix powder metal compact as described in U.S. Patent Application No. 2011/0132143 to Xu et al, herein incorporated by reference in its entirety. As shown in FIG. 6, an exemplary embodiment of the powder metal compact 200 includes a substantially-continuous, cellular nanomatrix 216 having a nanomatrix material 220, a plurality of dispersed particles 214 including a particle core material 218 that includes Mg, Al, Zn or Mn, or a combination thereof, dispersed in the cellular nanomatrix 216, and a solid-state bond layer extending throughout the cellular nanomatrix 216 between the dispersed particles 214. The resultant powder metal compact 200 is a lightweight, high-strength metallic material that is selectably and controllably disposable or degradable. The fully-dense, sintered powder compact 200 includes lightweight particle cores and core materials having various single layer and multilayer nanoscale coatings. The compact 200 has high mechanical strength properties, such as compression and shear strength and controlled dissolution in various wellbore fluids. As used herein, "cellular" is used to indicate that the nanomatrix 216 defines a network of generally repeating, interconnected, compartments or cells of nanomatrix material 220 that encompass and also interconnect the dispersed particles 214. As used herein, "nanomatrix" is used to describe the size or scale of the matrix, particularly the thickness of the matrix between adjacent dispersed particles 214. The metallic coating layers, that are sintered together to form the nanomatrix 216, are themselves nanoscale thickness coating layers. Since the nanomatrix 216 at most locations, other than the intersection of more than two dispersed particles 214 generally comprises the interdiffusion and bonding of two coating layers from adjacent powder particulates having a nanoscale thicknesses, the matrix formed also has a nanoscale thickness (e.g., approximately two times the coating layer thickness) and is thus described as a nanomatrix 216. The powder compact 200 is configured to be selectively and controllably dissolvable in a borehole fluid in response to a changed condition in the borehole 12. Examples of the changed condition that may be exploited to provide selectable and controllable dissolvability include a change in temperature or borehole fluid temperature, change in pressure, change in flow rate, change in pH or change in chemical composition of the borehole fluid, or a combination thereof. Because of the high strength and density of the above-described plug material 28, the production openings 26 plugged with the plugging material 28 are able to hold pressure within the casing 16 when the casing 16 is pressured up to perform the fracturing operations. In the open hole application, the plug material 28 subsequently dissolves, after the fracturing operations are completed and the production tubular 30 is run into the casing 16, leaving the porous material 32 within the production openings 26 to prevent sand and other debris from flowing into the casing 16 and the production tubular 30. In the cased application, the plug material 28 at the leading end 60 of the production telescoping units 34 likewise dissolve after the fracturing operations are completed and the production tubular 30 is inserted, leaving the telescoping units 34 free to receive production fluids flowing therethrough. The sleeves 24 cover the fracturing openings 20 after the fracturing operations are completed to prevent any sand from entering through the fracturing openings 20, and therefore the casing 16 provides the necessary sand control operation without the need for a separate screen tubular positioned exteriorly of the production tubular 30.

Figure 7:
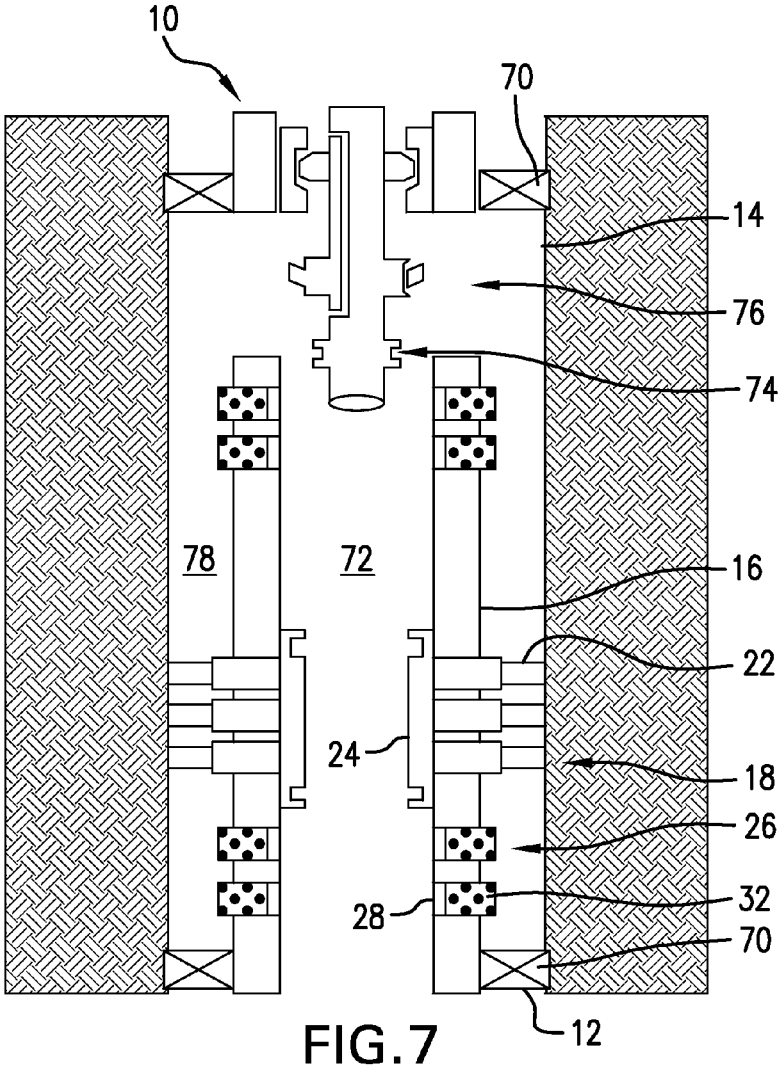
FIG. 7 shows a cross-sectional view of an exemplary embodiment of a portion of the completion system of FIG. 1 in an open hole.

FIG. 7 shows the system 10 prior to completion with a production tubular 30 and packer 38. The system 10 is shown positioned in an open borehole 12 with the casing 16 secured relative to the formation wall 14 with at least one pair of open hole packers 70 to distinguish the enclosed area therebetween as a zone 72 for production. The depicted zone 72 includes at least one fracturing assembly 18 having at least one fracturing telescoping unit 22. During run-in, the telescoping unit 22 is in a retracted position to prevent damage thereto and the frac sleeve 24 can be positioned so that the fracturing openings 20 are exposed. After placed in a desired area of the borehole 12 for performing a frac job, the telescoping unit 22 is extended as shown in FIG. 7 to move into contact with the formation wall 14. A service string 74 is provided that is illustrated to include a locator to confirm or correlate tool position relative to locator nipple 76, a slick joint with bypass, and a frac sleeve shifting tool for moving the frac sleeve 24 to block the openings 20 of the fracturing telescoping units 22 when the fracturing operation is completed. In this exemplary embodiment, because the casing 16 is not cemented but instead an annulus 78 is provided for the inflow of production fluids, the casing 16 includes production openings 26 provided with the above-described plugging material 28 on an interior of the casing 16 to maintain the frac pressure. The porous material 32 is also provided in the production openings 26 for filtering the production fluids entering an interior of the casing 16. After the frac operation is completed and the IWS/packer string (production tubular 30 and packer 38) is inserted, the plugging material 28 is dissolved from the production openings 26 and the porous material 32 remains intact for sand control as the production fluids enter an interior of the casing 16 towards the production tubular 30. Using the system 10 shown in FIG. 7, a borehole size of 8½" is capable of permitting an IWS size of 3½" through a casing ID of 6", or approximately 41% of the borehole 12. Also, a borehole size of 10¾" is capable of permitting an IWS size of 5½" through a casing ID of 8", or approximately 51% of the borehole 12.

Figure 8:
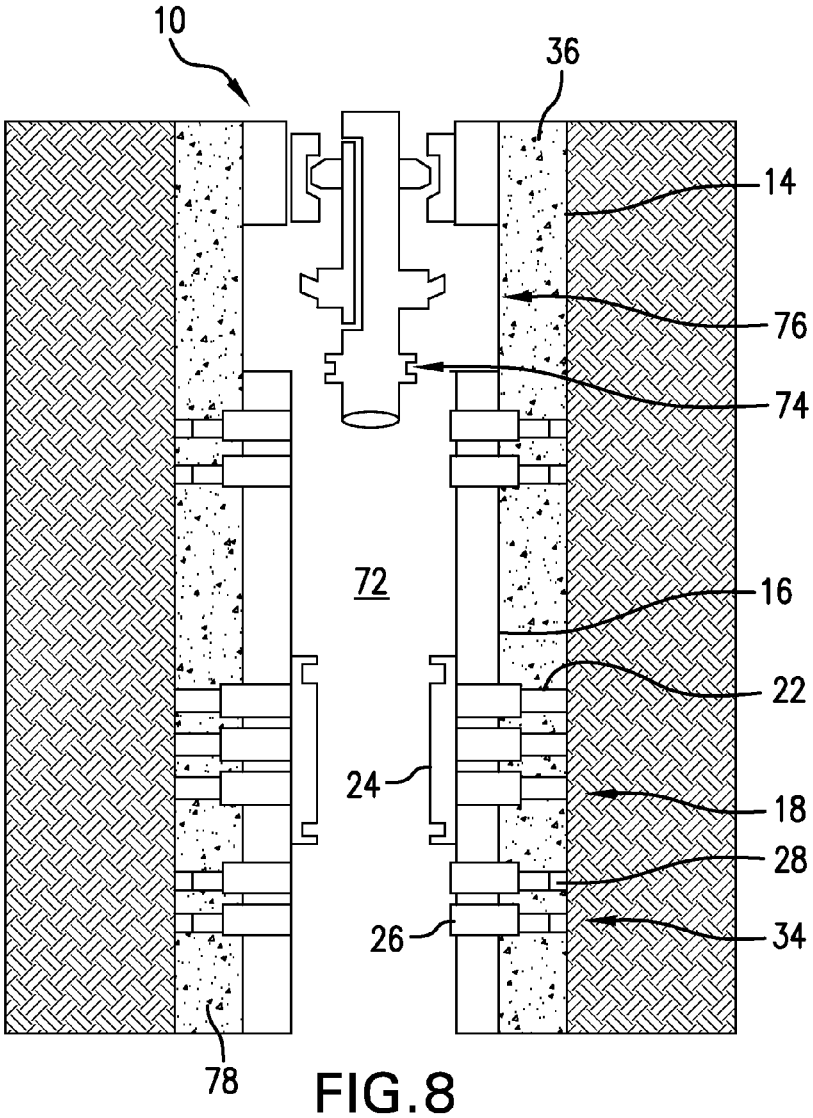
FIG. 8 shows a cross-sectional view of an exemplary embodiment of a portion of the completion system of FIG. 1 in a cased hole.

FIG. 8 also shows the system 10 prior to completion with the IWS/packer string 30, 38. The system 10 of FIG. 8, however, is shown positioned in a cased borehole 12 with the casing 16 secured relative to the formation wall 14 with cement 36. The depicted zone 72 includes at least one fracturing assembly 18 having at least one fracturing telescoping unit 22. Due to the cement 36 which fills the annulus 78 between the casing 16 and the formation wall 14, the production openings 26 must also include telescoping units 34. The plugging material 28 of the production openings 26 is placed at a leading end 60 (a formation wall contacting end) of the production telescoping units 34 to force the production telescoping units 34 into their extended position via the internal pressure. During run-in, the telescoping units 22, 34 of both the fracturing assembly 18 and the production opening 26 are in their retracted positions to prevent damage thereto. After being placed in a desired area of the borehole 12 for performing a frac job, the telescoping unit 22 of the fracturing assembly as well as the telescoping unit 34 of the production opening 26 are extended as shown to move into contact with the formation wall 14. The annulus 78 may then be cemented. As in the open borehole 12 application, the service string 74 is provided. After the frac operation is completed and the IWS/packer string 30, 38 is inserted, the plugging material 28 in the production opening 26 is dissolved. If screen material 32 is provided as shown in FIG. 3, it will remain intact for sand control as the production fluids enter an interior of the casing 16 towards the production tubular 30. Using the system 10 shown in FIG. 8, a borehole size of 8½" is capable of permitting an IWS size of 4½" through a casing ID of 6½", or approximately 53% of the borehole 12. Also, a borehole size of 10¾" is capable of permitting an IWS size of 5½" through a casing ID of 8", or approximately 51% of the borehole 12.

Figure 9:
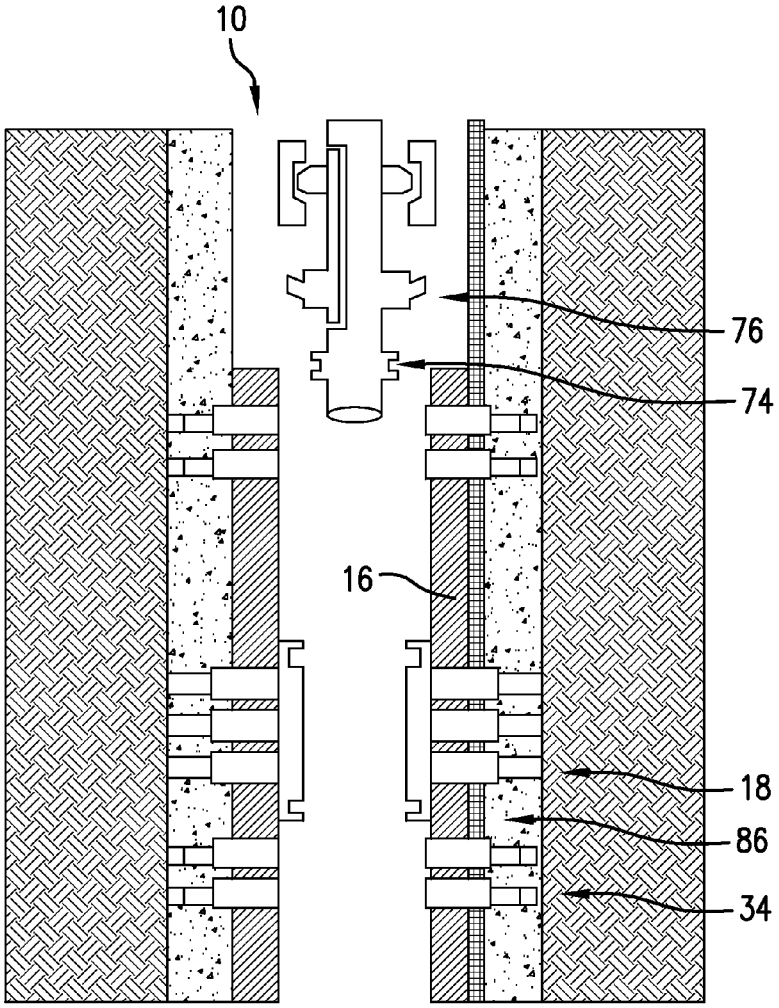
FIG. 9 shows a cross-sectional view of an exemplary embodiment of a portion of the completion system of FIG. 1 in a cased hole and in combination with an exemplary fiber optic sensor array.

FIG. 9 shows another exemplary embodiment of a cased application of the fracturing and sand control system 10. This embodiment is similar to that shown in FIG. 8 but additionally includes a distributed temperature sensing ("DTS") fiber optic sensor array cable 86 on an exterior of the casing 16. It is important to note that such an arrangement would not be feasible if the cemented casing 16 was perforated using a perforating gun. While a DTS cable 86 is shown, it should be understood that alternate intelligent, fiber optic, and/or electrical cables and/or systems may also be placed on or relative to the casing 16 that would otherwise be damaged during a perforating process.

Figure 10:
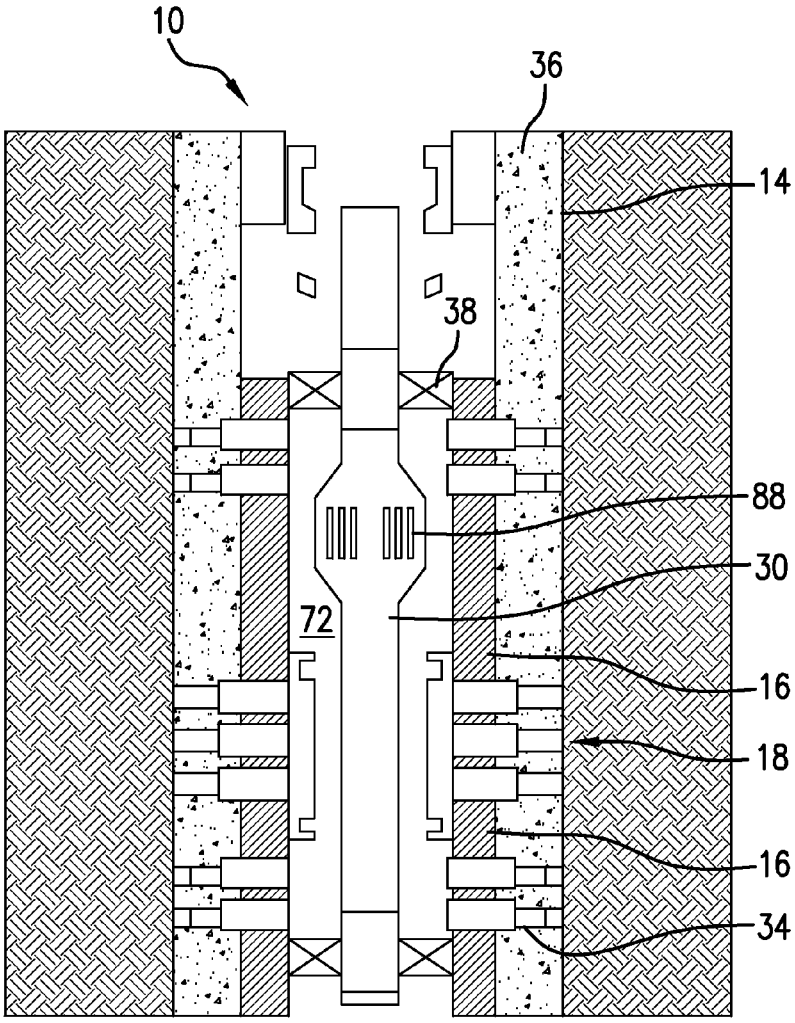
FIG. 10 shows a cross-sectional view of an exemplary embodiment of the completion system of FIG. 1 in a cased hole; and, FIG. 11 shows a cross-sectional view of an exemplary embodiment of the completion system of FIG. 1 in a cased hole and depicting a method of fracturing and production.

FIG. 10 shows the system 10 of FIG. 8 with a production tubular 30 inserted therein. The illustrated IWS/packer string 30, 38 regulates production with an interior valve and isolated in a depicted zone 72 using the packers 38. The IWS 30 may include additional sand control redundancy using the porous screen material 32 described above placed within ports 88 of the IWS 30.

Figure 11:
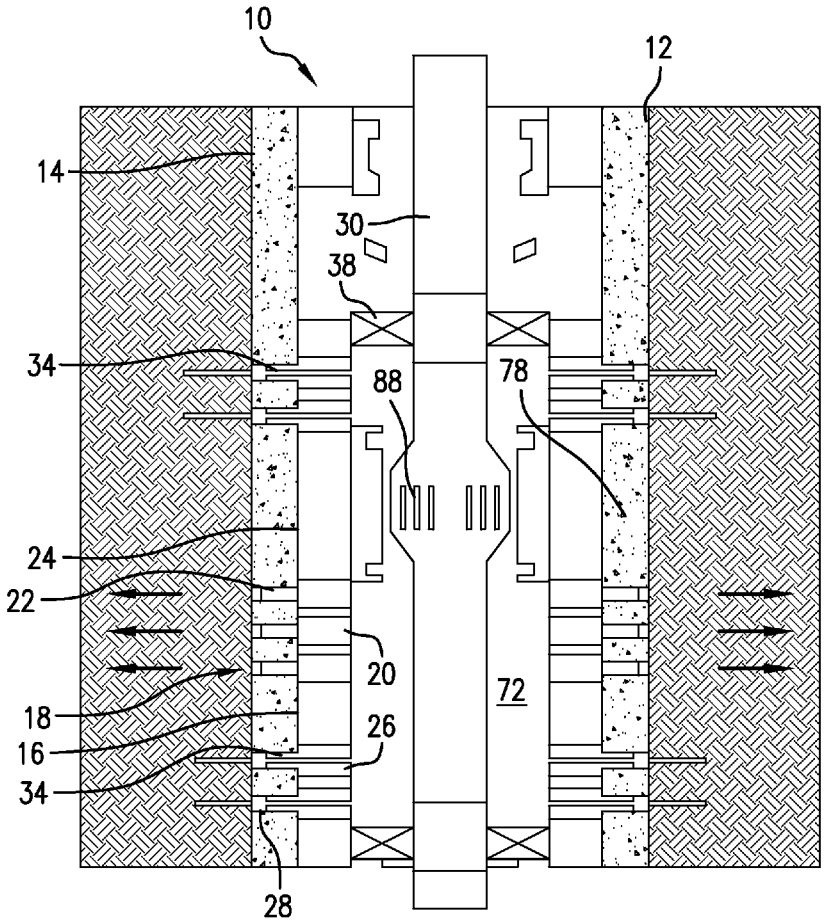

A method of employing the system 10 shown in FIG. 10 is described with respect to FIG. 11. The casing 16 of the system 10 is run into a borehole 12 with a service string 74 (shown in FIGS. 7-9) at the bottom or downhole end. Through the bypass of the service string 74, the pad is flushed to clean the borehole 12. The casing 16 is pressured to extend the telescoping units 22, 34 of the fracturing assembly 18 and the production openings 26. The annulus 78 between the casing 16 and the formation wall 14 is then cemented. Liner hanger packers are set. Then, the profile/seal bore is located and set down weight applied. The illustrated zone 72 is fractured by rupturing a disc/plug in the telescoping unit 22 of the fracturing assembly 18 and passing fracturing fluid therethrough including a washout procedure performed in the fractures. The profile of the frac sleeve 24 is engaged by the shifting tool and shifted to a closed position to cover the fracturing openings 20. The service string 74 is pulled up to a next zone. When the zones have been fractured, an inner completion string (production tubular 30) is run through the casing 16. The plugging material 28 is dissolved and production fluids are produced through the production openings 26 and into the ports 88 of the production tubular 30.

Thus, a novel approach to a multi-zone one trip fracturing sand control completion has been described that vastly increases production quantity by enabling the use of larger production tubulars 30 within standard sized casings 16. A larger area for the stimulation workstring is also provided without erosion or pump rate limiting issues for the multizone one trip stimulation. Perforation is eliminated in cased hole applications, and issues with perforating fines migration are thus eliminated. External DTS applications are allowed in cased and cemented wellbores. Sand control is also ensured. Overall, well performance is improved while lowering cost and expanding IWS options.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A multi-zone fracturing and sand control completion system employable in a borehole, the system comprising:

a casing;

a fracturing assembly including a fracturing telescoping unit extendable from the casing to the borehole and a frac sleeve movable within the casing to expose the fracturing telescoping unit during a fracturing operation and to block the fracturing telescoping unit after the fracturing operation is completed; and, an opening in the casing, the opening including a porous material and a dissolvable plugging material, the dissolvable plugging material capable of maintaining frac pressure in the casing during the fracturing operation through the telescoping unit, and the porous material including at least two different materials fused together by exothermic heat resulting from solid state reactions between alternating layers of the at least two different materials.

2. The system of claim 1 further comprising a tubular inserted within the casing, wherein an outer diameter of the tubular is greater than 35% of an inner diameter of the borehole.

3. The system of claim 1, wherein the plugging material in the opening is capable of withstanding at least 10,000 psi.

4. The system of claim 1, wherein the plugging material is a nanomatrix powder metal compact.

5. The system of claim 1, wherein the opening further includes a telescoping unit extendable from the casing to the borehole, and the plugging material is positioned at a borehole contacting end of the telescoping unit of the opening.

6. The system of claim 5, further comprising cement positioned in an annulus between the casing and a borehole wall, the fracturing telescoping unit and the telescoping unit of the opening extended to the borehole wall prior to a cementing procedure.

7. The system of claim 1 wherein the opening in the casing includes at least one opening positioned uphole of the fracturing telescoping unit and at least one opening positioned downhole of the fracturing telescoping unit within a same zone of the system.

8. The system of claim 7 further comprising, within the casing, a first packer uphole of the fracturing telescoping unit and a second packer downhole of the fracturing telescoping unit to segregate a zone of the system from other zones in the system.

9. The system of claim 1 further comprising a fiber optic or sensor cable positioned on the casing.

10. A multi-zone fracturing and sand control completion system employable in a borehole, the system comprising:

a casing;

a fracturing assembly including a fracturing telescoping unit extendable from the casing to the borehole and a frac sleeve movable within the casing to expose the fracturing telescoping unit during a fracturing operation and to block the fracturing telescoping unit after the fracturing operation is completed;

an opening in the casing, the opening including a dissolvable plugging material capable of maintaining frac pressure in the casing during the fracturing operation through the telescoping unit; and, a tubular inserted within the casing, wherein ports in the tubular further include a porous material of at least two different materials fused together by exothermic heat resulting from solid state reactions between alternating layers of the at least two different materials.

11. A method of operating within a borehole using the system of claim 1, the method comprising:

providing the casing within the borehole, the borehole having a diameter between approximately 8.5" and 10.75"; and, running a tubular within the casing, the tubular having an outer diameter greater than 2⅞".

12. The method of claim 11, further comprising, prior to running the tubular within the casing, fracturing a formation wall through the fracturing telescoping unit extending from the casing to the formation wall while maintaining frac pressure in the casing with the plugging material in the opening in the casing.

13. The method of claim 12, further comprising, prior to fracturing, extending the fracturing telescoping unit and extending a telescoping unit from the opening in the casing to a formation wall of the borehole, and cementing an annulus between the casing and the formation wall.

14. The method of claim 13, further comprising dissolving the plugging material subsequent running the tubular within the casing.

15. A method of operating within a borehole using the system of claim 1, the method comprising:

providing the casing within the borehole;

extending the fracturing telescoping unit of the fracturing assembly from the casing to a formation wall of the borehole;

fracturing the formation wall through the fracturing telescoping unit;

moving the frac sleeve within the casing to block the fracturing telescoping unit;

running a tubular within the casing; and dissolving the plugging material, wherein the plugging material is capable of maintaining frac pressure within the casing during the fracturing operation.

16. The method of claim 15, further comprising extending a telescoping unit from the casing opening to the formation wall and cementing an annulus between the casing and the formation wall.

17. The method of claim 15, further comprising providing a porous material in the casing opening.

18. The method of claim 15, wherein running a tubular includes running a tubular that has an outer diameter greater than 35% of a diameter of the borehole.

* * * * *